US007852711B1

(12) United States Patent
Fitzgerald et al.

(10) Patent No.: US 7,852,711 B1
(45) Date of Patent: Dec. 14, 2010

(54) PORTABLE DEVICE USING LOCATION DETERMINATION AND MEMS TIMEKEEPING TO UPDATE AND KEEP TIME

(75) Inventors: Alissa M. Fitzgerald, Menlo Park, CA (US); Dave Mooring, Los Altos Hills, CA (US)

(73) Assignee: Pillar, LLC, Los Altos, CA (US)

( * ) Notice: Subject to any disclaimer, the term of this patent is extended or adjusted under 35 U.S.C. 154(b) by 428 days.

(21) Appl. No.: 12/037,015

(22) Filed: Feb. 25, 2008

(51) Int. Cl.
*G04B 19/22* (2006.01)
*G04C 11/02* (2006.01)

(52) U.S. Cl. ..... 368/21; 368/11; 368/47; 368/155

(58) Field of Classification Search ..... 368/11, 368/21, 47, 155; 331/154
See application file for complete search history.

(56) References Cited

U.S. PATENT DOCUMENTS 4,479,722 A * 10/1984 Salah ..... 368/17
5,089,814 A * 2/1992 DeLuca et al. ..... 340/825.49
5,375,018 A * 12/1994 Klausner et al. ..... 368/47
5,724,316 A * 3/1998 Brunts ..... 368/10
6,278,660 B1 * 8/2001 Tognazzini ..... 368/21
7,391,273 B2 * 6/2008 Seki et al. ..... 331/47
2009/0196124 A1 * 8/2009 Mooring ..... 368/204

* cited by examiner

*Primary Examiner*—Vit W Miska
(74) *Attorney, Agent, or Firm*—Fernandez & Associates, LLP

(57) ABSTRACT

Devices and methods for determining a current location using a location detection element, determining a local time zone based on the current location using a memory unit, keeping time using a micro-electro-mechanical-system (MEMS) oscillator unit co-fabricated on a common substrate with the location detection element, and determining a local time based on the local time zone using a controller element. Optional embodiments comprise a MEMS oscillator unit that is fabricated underneath, next to, or on top of the location detection element. Additional embodiments comprise a GPS chip optionally assisted by a cell phone chipset or FM receiver to enhance location and time determination. Optional embodiments may additionally enter a power conservation mode after the current location has been determined, or may detect air travel to disable the location detection element and enable the location detection element upon detected landing.

30 Claims, 7 Drawing Sheets

PORTABLE DEVICE USING LOCATION DETERMINATION AND MEMS TIMEKEEPING TO UPDATE AND KEEP TIME

BACKGROUND

1. Field

The field of the present invention relates generally to devices for keeping track of time, and specifically to a device for determining current local time using a location detection element and a micro-electro-mechanical-system (MEMS) oscillator that is also power efficient and compact in volume.

2. Related Art

Travelers, when crossing time zones, need to figure out what the local time is, and then manually reset their wristwatches. When traveling from airport to airport, it is easy to identify which time zone one is in, due to onboard announcements and visible clocks in the airport. However, there are many conditions in which one's time zone is not immediately apparent, such as traveling by car or by boat, or to remote regions. Periodic synchronization of one's watch with an absolute time standard such as that provided by Global Positioning System (GPS) satellite signals or General Packet Radio Service (GPRS) cell phone radio communications is also desired.

Furthermore, one must manually adjust a watch to display the new time. The user may forget to reset the time, or not be able to do it immediately, either of which could result in an inaccurate time display.

SUMMARY

Embodiments of the present invention are directed to devices and methods for determining a current location using a location detection element, determining a local time zone based on the current location using a memory unit comprising a lookup table, keeping time using a MEMS oscillator unit co-fabricated on a common substrate with the location detection element, and determining a local time based on the current time zone using a controller element.

In an optional embodiment, a time zone given by another location of a user's choosing is used to determine a current time. For example, a user traveling in England may want the device to display the local time in California in the United States, and such an embodiment would display a current time based on the time zone given by the location of California rather than England. In another optional embodiment, the device may compute and present more than one time zone, such as a current time zone corresponding to the location of the device and one or more other time zones of a user's choosing.

In one embodiment, the MEMS oscillator unit is fabricated prior to and underneath the location detection element on the same silicon substrate.

In another embodiment, the MEMS oscillator unit is fabricated adjacent to the location detection element on the same silicon substrate.

In another embodiment, the MEMS oscillator unit is fabricated above the location detection element on the same silicon substrate.

In another embodiment, the MEMS oscillator unit is a separate chip which is mounted above or adjacent to the location detection element using a technique known as multichip module assembly.

In another embodiment, the MEMS oscillator unit is a separate element which is mounted to the same circuit board as the location detection element.

In another embodiment, the location detection element comprises a GPS chip, optionally assisted by a cell phone chipset or FM receiver used to enhance accuracy of location determination when a cellular signal or FM radio broadcast is available.

In another embodiment, the controller further causes the lookup table to be periodically refreshed via download to update international time zone information or daylight savings information.

In another embodiment, the controller causes the location detection element to enter a power conservation mode after the current location has been determined.

In another embodiment, after the current location has been determined, the controller further activates location-specific functions on the device, such as displaying the local city and country name, local maps, local transportation information, the exchange rate for the currency of the new location and updating calendar reminders.

In other embodiments, the device is further programmed to automatically determine the current location by activating the location detection element at regular intervals, or to allow a user to manually cause the device to determine the current location.

In other embodiments, the device receives an exact time from a GPS satellite signal, in order to synchronize the device with an absolute time standard.

Another embodiment further comprises a pressure detection element, wherein pressure data received over time from the pressure detection element is used to determine whether air travel has occurred. Optionally, the controller further disables the location detection element during detected air travel and enables the location detection element upon detected landing.

Another embodiment uses data from the pressure detection element to calculate altitude, and thereby reduce the number of satellites needed for the GPS chip to calculate an accurate location from four to three.

BRIEF DESCRIPTION OF DRAWINGS

The drawings illustrate the design and utility of embodiments of the present invention, in which similar elements are referred to by common reference numerals. In order to better appreciate the advantages and objects of the embodiments of the present invention, reference should be made to the accompanying drawings that illustrate these embodiments. However, the drawings depict only some embodiments of the invention, and should not be taken as limiting its scope. With this caveat, embodiments of the invention will be described and explained with additional specificity and detail through the use of the accompanying drawings in which.

DETAILED DESCRIPTION

In the following description, for purposes of explanation, numerous specific details are set forth in order to provide a thorough understanding of the invention. It will be apparent, however, to one skilled in the art that the invention can be practiced without these specific details.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1:
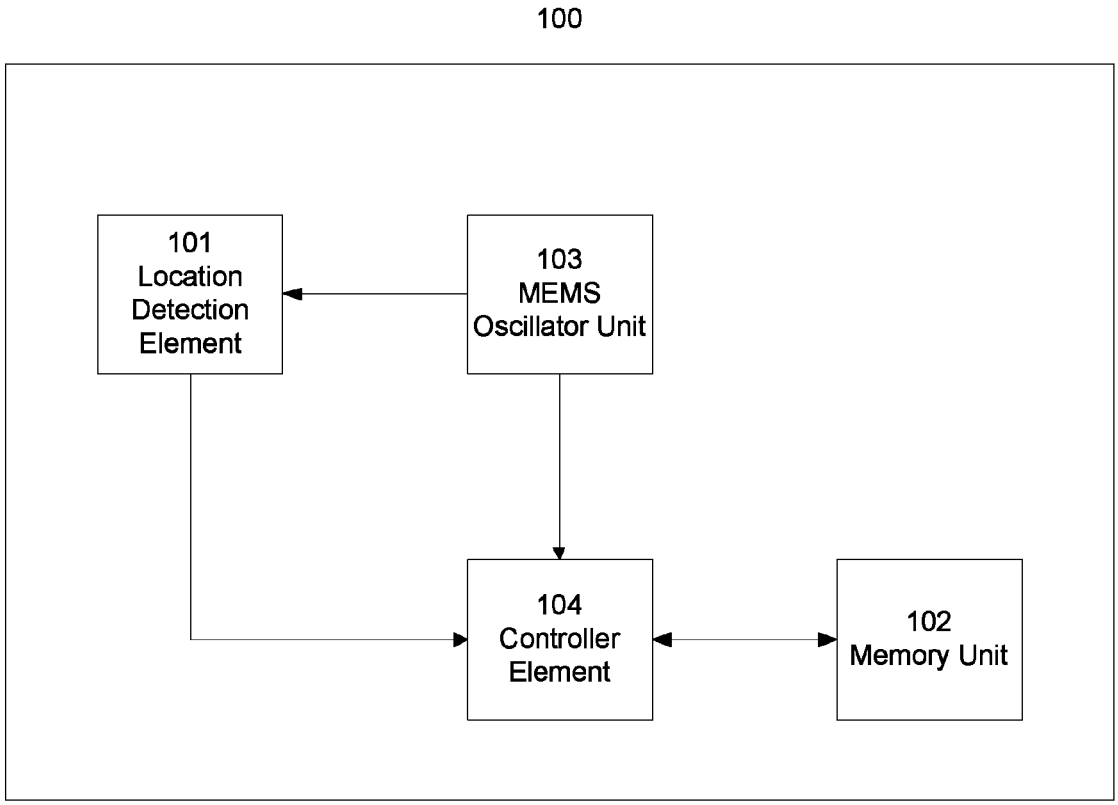
FIG. 1 is a system diagram showing a device for determining a current time based on a detected current location, determined time zone, and MEMS timekeeping.

In accordance with one embodiment of the present invention, FIG. 1 is a system diagram showing a device 100 for determining a current local time comprising a location detection element 101, a memory unit 102, a MEMS oscillator unit 103, and a controller element 104. A location detection element 101 is used to detect a current location of the device 100 and to determine an absolute time, such as Coordinated Universal Time (UTC) or Greenwich Mean Time (GMT). Alternatively, the location detection element 101 may determine any other time that can serve as reference for the time calculation processes presented herein. A MEMS oscillator unit 103 is used to keep time on the device. A memory unit 102 comprises a time zone lookup table associating location information with time zone information. A controller 104 combines location information given by the location detection element and time zone information given by the lookup table while keeping time with the MEMS oscillator unit 103 to synchronize the absolute time to UTC, GMT, or another reference time and determine the local time for the time zone according to the detected current location of the device 100.

Figure 2:
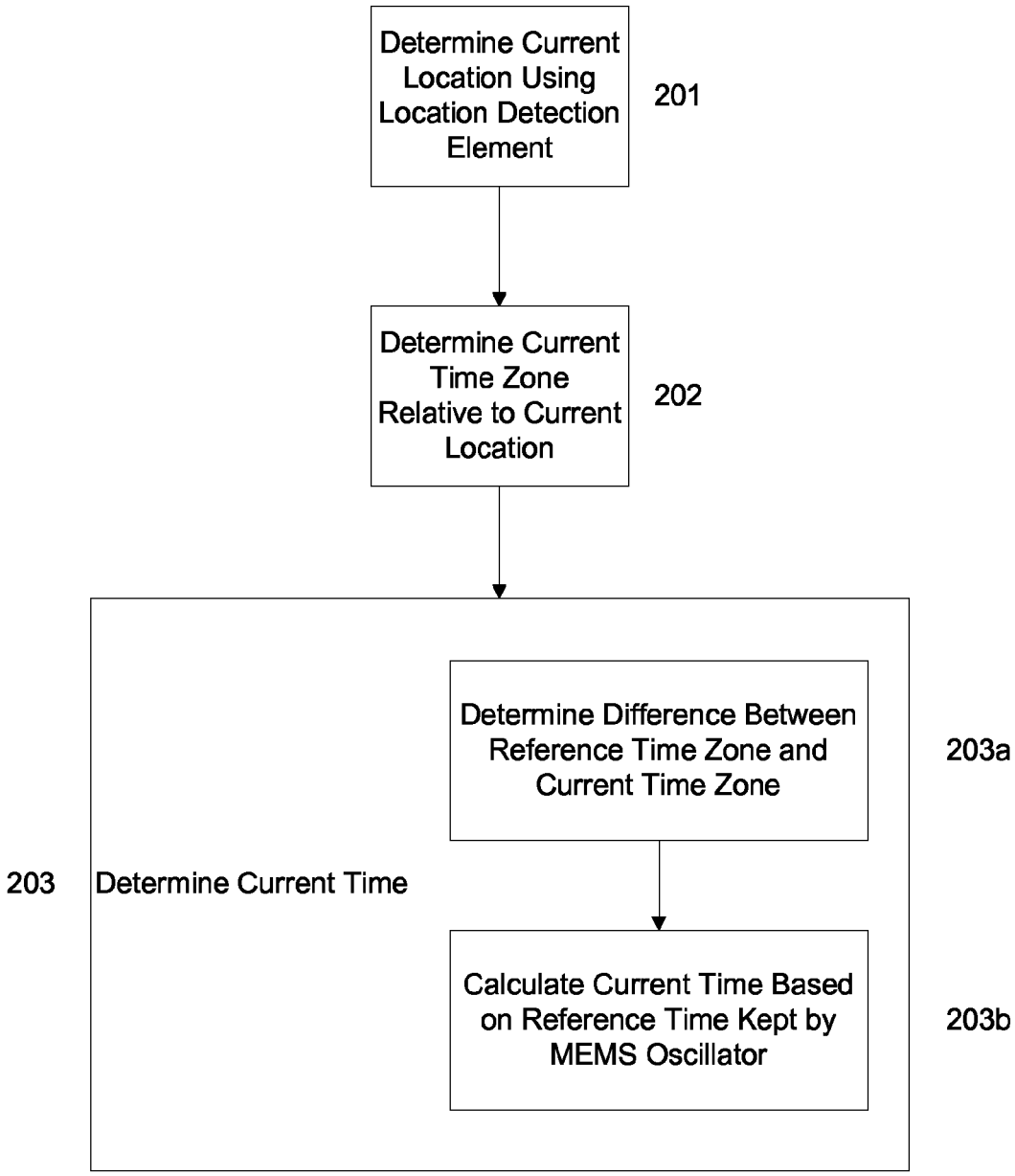
FIG. 2 is a flow diagram showing a method for determining a current time based on a detected current location, determined time zone, and MEMS timekeeping.

In accordance with another embodiment of the present invention, FIG. 2 is a flow diagram showing a method for determining a current local time using a device comprising a location detection element 101, a controller element 104, a MEMS oscillator unit 103, and a memory unit 102. A current location is determined using a location detection element 201. An absolute time (such as UTC) may also be determined by the location detection element 101, which receives precise time data from a satellite signal. A current time zone is determined relative to the current location 202. According to one embodiment of the invention, the local time zone is determined using a controller element 104 combining location information given by the location detection element 101 and time zone information given by a lookup table stored in a memory unit 102 or downloaded in real-time from the internet. Alternatively, the lookup table may be replaced with any other data structure that associates time zones with locations, such as a database, tree, hash table, or other suitable data structure. A difference is calculated between the absolute time standard, UTC, GMT, or other reference time, and a determined local time zone 203*a*, and the local time is then kept by a MEMS oscillator unit 203*b* until the next time an update event is triggered.

Figure 3:
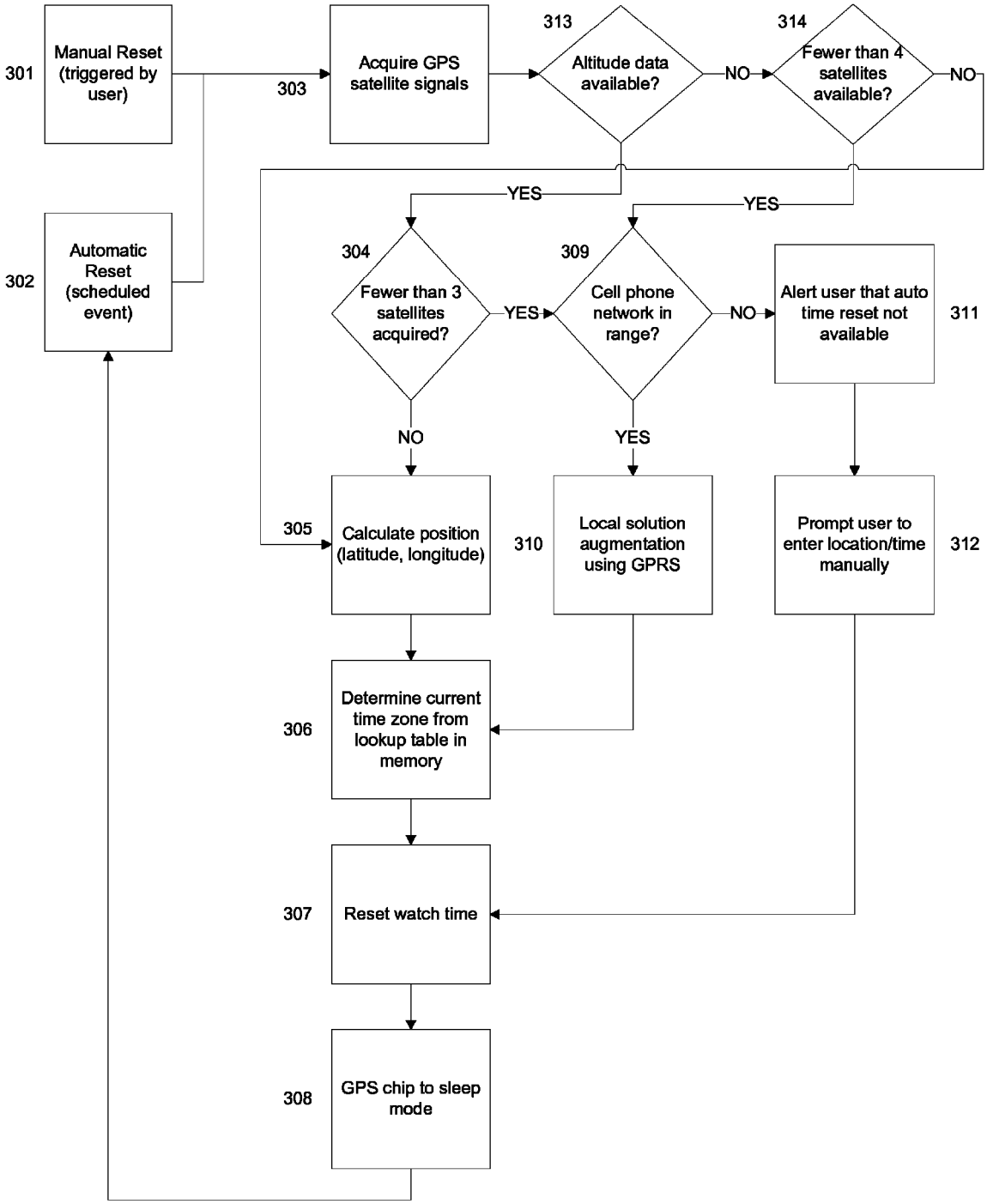
FIG. 3 is a flow diagram showing a method by which an embodiment of the present invention updates time by determining a current local time.

In accordance with another embodiment of the present invention, FIG. 3 is a flow diagram showing a method by which an embodiment of the present invention updates time using a device comprising a location detection element 101, a controller element 104, a MEMS oscillator unit 103, a memory unit 102, and a cell phone chipset. An updating process may occur through a manual reset 301 triggered by the device user or through a scheduled automatic reset 302, which causes the device to attempt to acquire GPS satellite signals 303. The number of satellite signals acquired determines the device's next action 304.

If four or more satellite signals are acquired, the device may calculate a current position in latitude and longitude based on the satellite signals 305. If the device contains a pressure sensing element, whose data has been used to compute the local altitude, then only three satellite signals are needed to compute a current position in latitude and longitude 313. The local time is determined from a lookup table stored in a memory unit 306 or via real-time download from the internet. Based on the determined local time, the device resets its reference time 307. According to one embodiment of the present invention, the device may trigger the location detection element 101 (e.g. GPS chip) to enter a sleep mode to conserve power 308. Manual reset 301 or automatic reset 302 may be triggered by user or scheduled event to cause the location detection element to exit the sleep mode and attempt again to acquire satellite signals 303, restarting the process of determining a local time as previously described.

If fewer than three or four satellite signals are acquired 304, 314, the device may check to see if a cell phone network is in range 309, in accordance with one embodiment of the present invention. If a cell phone network is in range, General Packet Radio Service (GPRS) may be used to augment location determination 310 and a local time zone is determined from a lookup table stored in memory unit 306, continuing the process of determining the local time as previously described. If no cell phone network is in range, the device may alert a user that automatic time reset is not available 311 and prompt the user to manually enter a location and/or time 312. Based on the user-entered local time, the device resets its reference time 307 and may continue the process as previously described.

Figure 4:
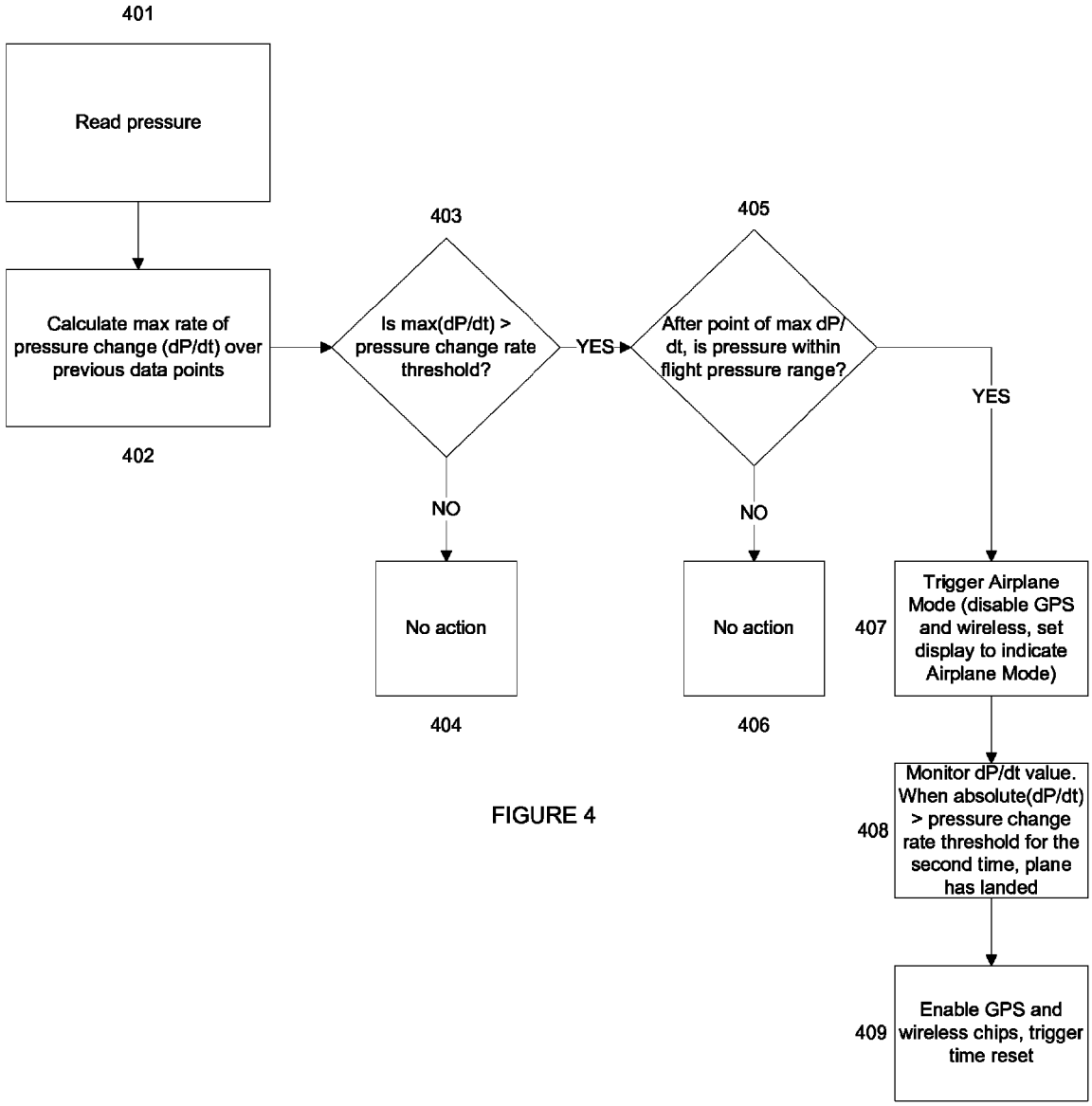
FIG. 4 is a flow diagram showing a process by which an embodiment of the present invention automatically triggers determination of a current local time by using detected pressure data to determine if airplane travel has occurred.

In accordance with another embodiment of the current invention, FIG. 4 is a flow diagram showing a process by which an embodiment of the present invention automatically triggers determination of a current time by detecting pressure data to determine if airplane travel has occurred, using a device comprising a location detection element 101, a controller element 104, a MEMS oscillator unit 103, a memory unit 102, and a pressure detection element. A pressure detection element reads barometric pressure 401. In a preferred embodiment, the pressure detection element reads at 15-minute intervals and retains buffer data for 24 hours, providing 96 data points. A maximum rate of pressure change (dP/dt) over previous data points is calculated 402. The device checks if the maximum dP/dt is greater than a pressure change rate threshold 403. For example, in one embodiment, the pressure change rate threshold is 5 millibars per minute. If the maximum dP/dt is not greater than the pressure change rate threshold, the device takes no action 404. If the maximum dP/dt is greater than the pressure change rate threshold, the device determines whether the pressure is within a flight pressure range after the point of maximum dP/dt 405. The flight pressure range may be defined to approximately match an aircraft's cabin pressure range so that the device can determine when the device is located onboard an aircraft in flight. For example, in one embodiment, the flight pressure range is between 750-850 millibars. If the determined pressure is not within the flight pressure range after the point of maximum dP/dt, the device takes no action 406. If the determined pressure is within the flight pressure range after the point of maximum dP/dt, the device triggers an airplane mode, disabling GPS and wireless chips and setting a display to indicate that the device is in the airplane mode 407. Rate of pressure change data is monitored, and when the absolute dP/dt exceeds the pressure change rate threshold for the second time 408, the device determines that an airplane landing has occurred and exits the airplane mode, enabling GPS and wireless chips and triggering a time reset 409 as previously described.

Figure 5:
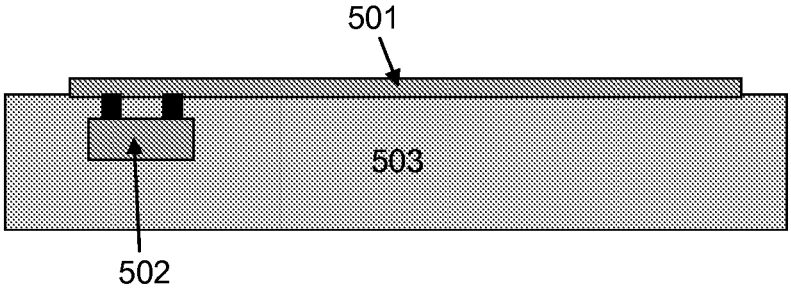
FIG. 5 is a cross-sectional diagram of an embodiment of the present invention, in which a MEMS oscillator unit has been fabricated prior to and underneath a location detection element which, in the illustrated embodiment, is a GPS chip.

FIG. 5 is a cross-sectional diagram of an embodiment of the present invention, in which the MEMS oscillator unit 502 has been fabricated prior to and underneath the location detection element (e.g. GPS CMOS circuitry) 501 on a common silicon chip 503.

Figure 6:
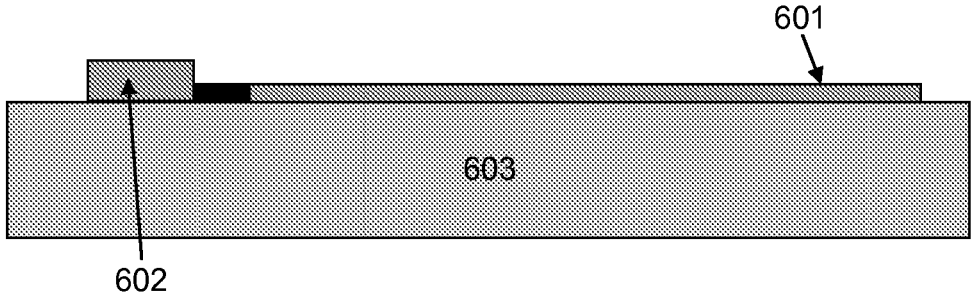
FIG. 6 is a cross-sectional diagram of an embodiment of the present invention, in which a MEMS oscillator unit has been fabricated adjacent to a location detection element which, in the illustrated embodiment, is a GPS chip.

FIG. 6 is a cross-sectional diagram of an embodiment of the present invention, in which the MEMS oscillator unit 602 has been fabricated adjacent to the location detection element (e.g. GPS CMOS circuitry) 601 on a common silicon chip 603.

Figure 7:
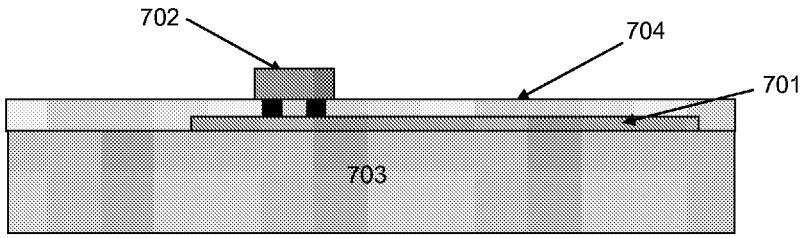
FIG. 7 is a cross-sectional diagram of an embodiment of the present invention, in which a MEMS oscillator unit has been fabricated on top of a location detection element which, in the illustrated embodiment, is a GPS chip.

FIG. 7 is a cross-sectional diagram of an embodiment of the present invention, in which a MEMS oscillator unit 702 has been fabricated on top of a location detection element (e.g. GPS CMOS circuitry) 701 on a common silicon chip 703 with a passivation layer 704 in between.

Figure 8:
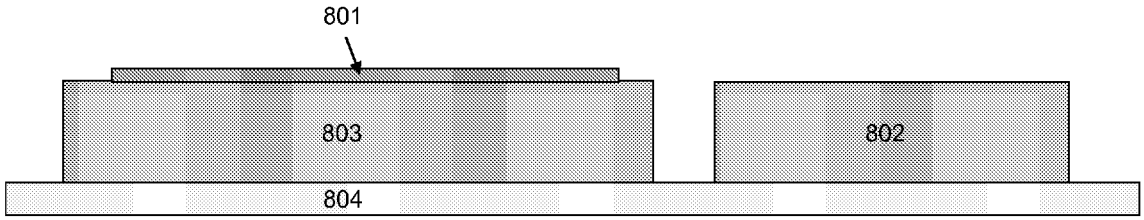
FIG. 8 is a cross-sectional diagram of an embodiment of the present invention, in which a MEMS oscillator chip has been assembled next to a location detection element which, in the illustrated embodiment, is a GPS chip.

FIG. 8 is a cross-sectional diagram of an embodiment of the present invention, in which a MEMS oscillator chip 802 has been assembled on a printed circuit board 804 next to a location detection element (e.g. GPS CMOS circuitry) 801 fabricated on a silicon chip 803.

Figure 9:
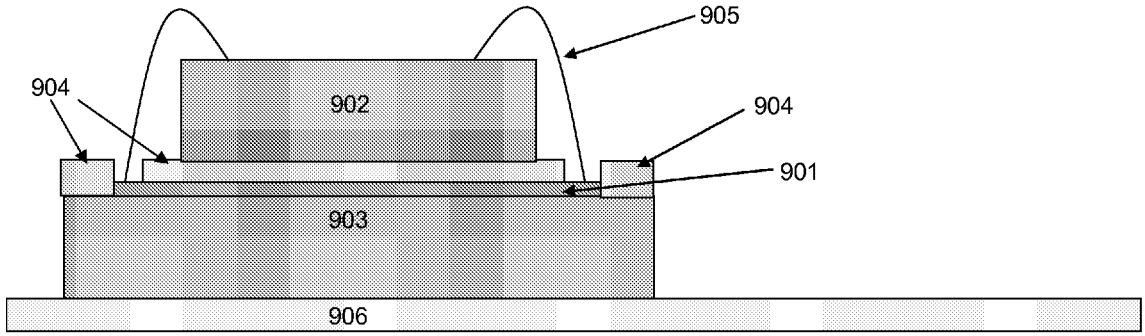
FIG. 9 is a cross-sectional diagram of an embodiment of the present invention, in which a MEMS oscillator chip has been assembled using the methods of multi-chip module assembly above a location detection element which, in the illustrated embodiment, is a GPS chip.

FIG. 9 is a cross-sectional diagram of an embodiment of the present invention, in which a MEMS oscillator chip 902 has been assembled using the methods of multi-chip module assembly using wirebonds 905 on top of a passivation layer 904 above a location detection element (e.g. GPS CMOS circuitry) 901 fabricated on a silicon chip 903 mounted on a printed circuit board 906. Other connection methods such as flip-chip bonding, ball grid arrays, and through silicon vias may be used in place of wirebonds 905.

Figure 10:
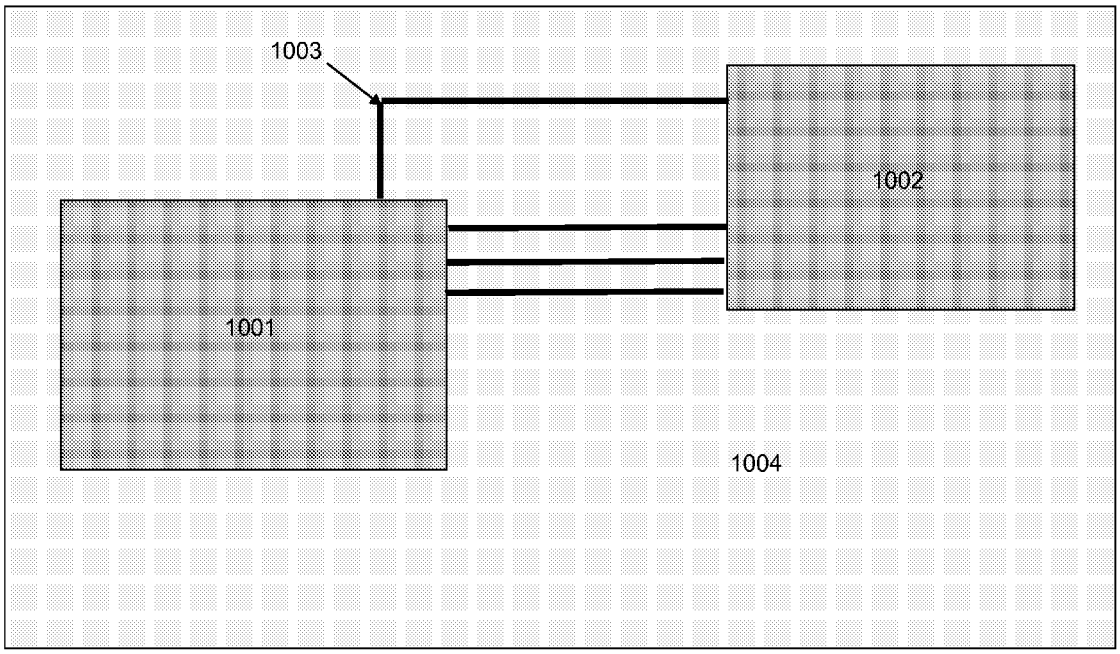
FIG. 10 is a plan-view diagram of an embodiment of the present invention, in which a MEMS oscillator chip has been installed on the same circuit board as a location detection element which, in the illustrated embodiment, is a GPS chip.

FIG. 10 is a plan-view diagram of an embodiment of the present invention, in which a MEMS oscillator chip 1002 has been installed on the same circuit board 1004 as a location detection element (e.g. GPS chip) 1001. The MEMS oscillator chip 1002 and location detection element 1001 are connected by interconnect copper traces 1003 on the circuit board 1004.

In one embodiment, the location detection element 101 comprises a GPS unit. The GPS unit may be used exclusively to determine location, in conjunction with one or more antennae, and is capable of determining and providing location data in longitude and latitude and absolute time data from a GPS broadcast. The GPS unit may detect location with greater precision using 4 GPS satellite signals than if fewer than 4 GPS satellite signals are used or available, though location detection is still possible with 3 GPS satellite signals, as a position determined within 1 km of the device's current location would suffice for time zone determination.

In another embodiment, the location detection element 101 comprises a cellular reception element, such as a cellular chipset. The cellular chipset may be used to communicate with cell phone towers to receive location and time information when a cell phone tower signal is available.

In another embodiment, the location detection element 101 comprises an FM receiver element. The FM receiver may receive FM radio broadcasts to obtain location and time information when such FM radio broadcasts are available.

Optionally, the cellular reception element and/or FM receiver may be used either exclusively or in conjunction with the GPS unit to augment GPS location determination. Cell phone tower information and FM radio broadcasts may provide location and time information, but unlike GPS, they are not planet-wide. Therefore, in one embodiment, the location detection element comprises a GPS unit, using cell phone tower information and/or FM radio broadcasts as secondary sources of location and time information to refine location determination in the case that fewer than 3 GPS satellite signals are available.

In one embodiment, the memory unit 102 comprises non-volatile memory, so that the time zone lookup table is retained across power cycles. The lookup table is stored in the memory unit 102 and comprises data associating location information with time zone information, allowing determination of a current time zone based on a current location provided by the location detection element. In turn, the time zone provided by the lookup table allows the device to determine a current time based on the current time zone. In a preferred embodiment, the lookup table can be periodically refreshed via download in order to stay up to date with the latest international time zone information, daylight savings, et cetera.

In one embodiment, the MEMS oscillator unit 103 comprises a MEMS oscillator commercially available off the shelf. The MEMS oscillator may comprise a mechanically resonant structure that vibrates at a pre-determined frequency, i.e. 1-125 MHz. An example of a commercially available product is the SiRes™ product line of MEMS oscillator chips, offered by the company SiTime (Sunnyvale, Calif.). Another is the PureSiliconResonator™ product line of MEMS oscillator chips, offered by the company Discera (San Jose, Calif.). The products offered by these companies are available as packaged oscillator chips for installation into circuit boards, or as bare silicon die, for multi-chip module assembly.

In another embodiment, the MEMS oscillator unit 103 is co-fabricated on a common substrate with the location detection element 101. The MEMS oscillator unit 103 of the present invention has significant benefits over the quartz oscillator of the current state of the art, because it is smaller in size and requires much lower power to operate, with accuracy that meets or exceeds that of quartz. Additionally, while quartz oscillators cannot be co-fabricated with silicon circuitry, MEMS oscillators can be co-fabricated with silicon circuitry and thus minimize chip volume. Any mutually compatible fabrication technique and/or process may be implemented to form the MEMS oscillator unit 103 on the same substrate as the location detection element. For example, the MEMS oscillator unit 103 may be fabricated prior to and underneath the location detection element 101 (e.g. GPS CMOS circuitry), as disclosed in U.S. Pat. No. 6,995,622 ("Frequency and/or phase compensated microelectromechanical oscillator"), incorporated herein by reference in its entirety. As another example, the MEMS oscillator unit 103 may be fabricated next to the location detection element 101 (e.g. GPS CMOS circuitry), as disclosed in U.S. Pat. No. 6,930,569 ("Micromechanical resonator having short support beams"), incorporated herein by reference in its entirety. Fabricating the MEMS oscillator unit 103 under, over, or adjacent to the location detection element 101 saves significant volume by eliminating the need for a separate oscillator chip and accomplishes the present invention's objective of minimizing device size.

In one embodiment, the controller 104 causes the location device to enter a power conservation mode, or sleep mode, after a current location has been detected, thus consuming less power. The controller 104 may use the current location, date, and time information to modulate the display brightness according to the availability of daylight at the user's current location, thereby conserving power and optimizing display visibility.

In another embodiment, the device is programmed to automatically determine the current location by activating the location detection element 101 at regular intervals. For example, the automatic determination of the current location may occur once per day. Additionally, the device may optionally allow a user to manually cause the device to determine the current location. In one such embodiment, the location detection element 101 will enter a power conservation mode after each such automatic or manually induced determination.

In another embodiment, the device allows a user to manually cause the device to determine the current location. The user may, for example, press a button or touchscreen on the device to trigger a manual reset, as described in FIG. 3.

While certain exemplary embodiments have been described and shown in the accompanying drawings, it is to be understood that such embodiments are merely illustrative and not restrictive of the broad invention and that this invention is not limited to the specific constructions and arrangements shown and described, since various other modifications may occur to those ordinarily skilled in the art upon studying this disclosure. In an area of technology such as this, where growth is fast and further advancements are not easily foreseen, the disclosed embodiments may be readily modifiable in arrangement and detail as facilitated by enabling technological advancements without departing from the principals of the present disclosure or the scope of the accompanying claims.

The invention claimed is:

1. A portable device comprising:

a location detection element for determining a current location;

a memory unit comprising a lookup table for determining a local time zone based on the current location given by the location detection element;

a MEMS oscillator unit for keeping time, wherein the MEMS oscillator unit and the location detection element are co-fabricated on a common substrate; and a controller element for determining a current time based on the local time zone.

2. The device of claim 1, wherein:

the MEMS oscillator unit is fabricated prior to and underneath the location detection element on the common substrate.

3. The device of claim 1, wherein:

the MEMS oscillator unit is fabricated adjacent to the location detection element on the common substrate.

4. The device of claim 1, wherein:

the MEMS oscillator unit is fabricated above the location detection element.

5. The device of claim 1, wherein:

the location detection element comprises a GPS chip.

6. The device of claim 1, further comprising:

a cell phone chipset to enhance accuracy of location and time determination and provide internet access capability when a cellular signal is available.

7. The device of claim 1, further comprising:

an FM receiver to enhance accuracy of location and time determination when an FM radio broadcast is available.

8. The device of claim 1, further comprising:

a network interface element for obtaining periodic updates to the lookup table, wherein the controller further causes the lookup table to be periodically refreshed via download to update international time zone and daylight savings information.

9. The device of claim 1, wherein:

the controller causes the location detection element to enter a power conservation mode after the current location has been determined.

10. The device of claim 1, further comprising:

a display, wherein the device modulates the display's brightness according to the available daylight at the current location, date, and time.

11. The device of claim 1, wherein:

the device is programmed to automatically determine the current location by activating the location detection element at regular intervals.

12. The device of claim 1, wherein:

a user can manually cause the device to determine the current location.

13. The device of claim 1, wherein:

the local time is determined based on a location other than the current location determined by the location detection element.

14. The device of claim 1, further comprising:

a pressure detection element, wherein pressure data received over time from the pressure detection element is used to determine whether air travel has occurred.

15. The device of claim 1, further comprising:

a pressure detection element, wherein pressure data is used to determine altitude for location determination.

16. The device of claim 14, wherein:

the controller further disables the location detection element during detected air travel and enables the location detection element upon detected landing.

17. A method of determining time comprising the steps of:

determining a current location using a location detection element;

determining a local time zone relative to the current location;

determining a current time based on a reference time updated to reflect a difference between a reference time zone and the determined local time zone, wherein the updated reference time is kept by a MEMS oscillator unit co-fabricated on a common substrate with the location detection element.

18. The method of claim 17, wherein:

the MEMS oscillator unit is fabricated prior to and underneath the location detection element.

19. The method of claim 17, wherein:

the MEMS oscillator unit is fabricated next to the location detection element.

20. The method of claim 17, wherein:

the MEMS oscillator unit is fabricated above the location detection element.

21. The method of claim 17, wherein:

the location detection element comprises a GPS chip.

22. The method of claim 17, further comprising the step of:

enhancing accuracy of location and time determination using a cell phone chipset when a cellular signal is available.

23. The method of claim 17, further comprising the step of:

enhancing accuracy of location and time determination using an FM receiver when an FM radio broadcast is available.

24. The method of claim 17, further comprising the step of:

periodically refreshing a lookup table via download to update international time zone and daylight savings information.

25. The method of claim 17, further comprising the step of:

causing the location detection element to enter a power conservation mode after the current location has been determined.

26. The method of claim 17, further comprising the step of:

activating the location detection element at regular intervals to automatically determine the current location.

27. The method of claim 17, further comprising the step of:

a user manually causing determination of the current location.

28. The method of claim 17, further comprising the steps of:

determining a pressure change over time using a pressure detection element; and determining whether air travel has occurred based on the pressure change over time.

29. The method of claim 28, further comprising the steps of:

disabling the location detection element during detected air travel; and enabling the location detection element upon detected landing.

30. A method of determining time comprising the steps of:

determining a current location using a location detection element;

determining a local time zone relative to the current location;

determining a current time based on a reference time updated to reflect a difference between a reference time zone and the determined local time zone, wherein the updated reference time is kept by a MEMS oscillator unit assembled on a common circuit board with the location detection element.

* * * * *